US005415134A

United States Patent [19]

Stewart, Jr.

[11] Patent Number: 5,415,134

[45] Date of Patent: May 16, 1995

[54] ENGINE COOLING SYSTEM FOR COOLING A VEHICLE ENGINE

[75] Inventor: Howard C. Stewart, Jr., High Point, N.C.

[73] Assignee: Stewart Components, High Point, N.C.

[21] Appl. No.: 145,886

[22] Filed: Oct. 29, 1993

[51] Int. Cl.[6] ..... F01P 9/00

[52] U.S. Cl. ..... 123/41.01; 123/41.47; 290/44; 290/55

[58] Field of Search ..... 123/41.01, 41.02, 41.12, 123/41.46, 41.47; 290/44, 55

[56] References Cited

U.S. PATENT DOCUMENTS

| | | | |
|---|---|---|---|
| 3,713,503 | 1/1973 | Haan | 290/44 |
| 3,894,521 | 7/1975 | Sakasegawa et al. | 123/41.12 |
| 4,074,662 | 2/1978 | Estes | 123/41.12 |
| 4,141,425 | 2/1979 | Treat | 290/55 |
| 4,168,456 | 9/1979 | Isobe | 123/41.12 |
| 4,423,705 | 1/1984 | Morita et al. | 123/41.02 |
| 4,691,668 | 9/1987 | West | 123/41.12 |
| 5,079,488 | 1/1992 | Harms et al. | 123/41.02 |
| 5,095,855 | 3/1992 | Fukuda et al. | 123/41.44 |
| 5,296,746 | 3/1994 | Burkhardt | 290/44 |

*Primary Examiner*—Noah P. Kamen

*Attorney, Agent, or Firm*—Bell, Seltzer, Park & Gibson

[57] ABSTRACT

An engine cooling system is provided for compactly and more efficiently pumping cooling fluid through an engine and a radiator of a vehicle. The engine cooling system has an engine, a charge storage device in electrical communication with the engine for supplying a charge to the engine, and a radiator in fluid communication with the engine for cooling fluid passing through the radiator from the engine. A pump is in fluid communication with the engine and the radiator for pumping fluid from the engine to the radiator and to the engine from the radiator. A fan, preferably compactly connected to the pump, cooperates with the radiator for cooling fluid circulating through the radiator, and a temperature sensor is connected to the engine for sensing the temperature of the engine. A pump control is in electrical communication with the temperature sensor and is connected to the pump for operating the pump when the temperature of the engine exceeds a predetermined value. A fan control is connected to the fan for controlling the operation of the fan and charging the charge storage device when the vehicle speed exceeds a predetermined value. The pump and fan controls preferably include the same motor which rotates the pump and the fan during non-operation and slow speed of the vehicle engine. The engine rotates the pump during high speed while the motor continues to operate the fan. During the rapid forward movement of the vehicle, the resulting airstream which engages the fan acts to rotate the fan and cause the motor to operate as a generator and charge the charge storage device.

28 Claims, 4 Drawing Sheets

ENGINE COOLING SYSTEM FOR COOLING A VEHICLE ENGINE

FIELD OF THE INVENTION

The invention relates to cooling systems and, more particularly, an engine cooling system for more efficiently cooling the engine of a vehicle.

BACKGROUND OF THE INVENTION

Internal combustion engines are in widespread use for various motor vehicles such as automobiles or trucks. Such vehicles usually have an engine cooling system which includes the engine that cooperates with a radiator and a pump for circulating cooling fluid, generally a mixture of water and antifreeze, to and from the engine. A fan is often used for cooperating with the radiator to cool fluid heated by the engine and passing through the radiator during operation of the vehicle.

In these motor vehicles, most heat related damage in and around the engine occurs when the engine is shut down or in an idle position because the cooling fluid no longer circulates through the engine cooling system and often boils behind the combustion chambers. A vehicle water (antifreeze/coolant) pump is often used in such systems for circulating fluid through the engine and radiator of the vehicle. The water pump conventionally has a drive shaft carried by the pump which is driven by the automobile engine via a pulley and a belt which cooperates with the water pump drive shaft and the engine crankshaft.

These water pumps conventionally operate only when the engine is running. The pumping of fluid through the engine cooling system ceases when the engine stops resulting in sharply rising engine block temperatures from the heat being built up in the fluid within the block. There is an excessive temperature increase, particularly in transverse mounted engines, front wheel drive automobiles, and other engines which have high operating temperatures also to reduce hydrocarbon and carbon monoxide emissions. These increased under-the-hood temperatures, in turn, significantly reduce the useful life for rubber and plastic parts in the engine compartment.

Also, although operation of the cooling fan is necessary when the engine is hot, such as occurs when the vehicle is stationary or is moving at low speeds and relatively high temperatures, much of the time operation of the fan occurs when it is not required. When the vehicle engine initially is started, the engine is cold and operation of the cooling fan prior to the time the engine warms up to its operating temperature clearly is not necessary. In addition, when a vehicle is operating at higher speeds, such as ordinarily encountered in highway driving and even in most aspects of city driving, sufficient air passes through the radiator to cool it without the cooling fan operating. This high speed air cooling process is also known as ram air cooling.

With increasing concern for efficiency in motor vehicle operation and, in addition, concern over the high cost of fuel for operating such vehicles, substantial effort has been devoted to improving the number of miles travelled for each gallon of fuel consumed. It is known that the radiator cooling fans require substantial amount of horsepower to rotate them. This is particularly true of large engine motor vehicles such as trucks or racing automobiles which require large radiators and correspondingly large cooling fans. Several horsepower of energy are consumed in the rotation of fans for such vehicles. Thus, the radiator fan is operated or being rotated by the engine when it is not necessary to effect cooling of the engine and a clear waste of engine horsepower results.

Additionally, when an engine is cold, it is not desirable to increase the flow of air through the radiator since this tends to lengthen the time required to heat the cooling fluid up to the desired operating temperature of the engine. Thus, it has been recognized that it is highly desirable to rotate the radiator cooling fan only when the temperature of the engine coolant is hot enough to require the operation of the cooling fan to draw air through the radiator.

In the case of a motor vehicle provided with an air conditioner, a condenser is also often mounted directly in front of the radiator of the engine thereby further restricting engine room ventilation. As a result, when the motor vehicle is forced to travel slowly on a congested urban street or the like, the engine is, and as is well known, overheated to the extent the engine may stall.

This stalling takes place primarily because the addition of the condenser disposed in front of the radiator increases the flow resistance of air passing air therethrough and therefore decreases the flow rate of air for cooling. Because the air temperatures increase when passing through the condenser, which generates heat when condensing the refrigerating medium of the air conditioner, air passing through and around the condenser then has a relatively high temperature when passing through the radiator.

When the engine stalls under such conditions, the temperature of the area surrounding the engine is increasingly raised due to heat generated by the engine itself or the exhaust gas from the fuel system. As a result, a phenomenon such as percolation or vapor lock often takes place and, accordingly, it becomes very difficult to restart the engine.

One known measure to prevent such overheating of the engine when driving at low speeds is to increase the flow rate of cooling air drawn by a fan. Various methods have been heretofore proposed based on this measure. These methods include, for example, a method for increasing the idling speed of the engine and a method of providing an electric motor to drive a fan. The former method; an example of which may be seen in U.S. Pat. No. 3,894,521 entitled "Overheat Preventing Device For Motor Vehicle Engine" by Sakasegawa et al., however, has disadvantages particularly in a vehicle provided with a torque converter that is accompanied with problems of creep and transmission shock and, in addition, the temperature of an exhaust gas purifier increases due to increased amount of engine exhaust during idling. The latter method, an example of which may be seen in U.S. Pat. No. 5,079,488 entitled "Electronically Commutated Motor Driven Apparatus" by Harms et al., also has disadvantages in that a considerable large space is required for provision of an electric motor, and often an additional fan, in the engine room (i.e., under the hood of the vehicle). Also, the positioning of the fan and electric motor often disturbs the smooth introduction of cold air when the motor vehicle is travelling at high speed. Other methods have included additional water pumps and a motor integral with the water pump. These other methods, however, likewise take an additional space in the engine compartment and are often complex and expensive.

SUMMARY OF THE INVENTION

The present invention provides a compact and more efficient engine cooling system that allows fluid, such as a water and antifreeze mixture, to circulate through the combustion chambers of the engine and to operate the fan even after the engine of the automobile shuts down or is in an idle position. The present invention also maintains the fan and the pump speed at a predetermined level to improve engine horsepower. The present invention further generates power to charge a charge storage device, such as a battery, in electrical communication with the engine so that the charge storage device, in turn, will provide a storage charge to the engine during start up operations.

More particularly, the engine cooling system has an engine and a charge storage device in electrical communication with the engine for supplying an electrical charge thereto. A radiator is in fluid communication with the engine for cooling fluid passing through the radiator. A pump is in fluid communication with the radiator and the engine for pumping the cooling fluid from the engine to the radiator and from the radiator to the engine. A fan, preferably compactly connected to the pump, cooperates with the radiator for cooling fluid circulating through the radiator. A temperature sensor is connected to the engine for sensing the temperature of the engine. A pump control is in electrical communication with the temperature sensor and connected to the pump for operating the pump responsive to the sensed temperature of the engine exceeding a predetermined value. A fan control connected to the fan controls the operation of the fan and charges the charge storage device responsive to the vehicle exceeding a predetermined speed.

Also, according to the present invention, a pump system is provided that circulates cooling fluid through the engine and the radiator to thereby cool the engine. The pump system has a pump including a drive shaft. A first flange is coaxially mounted about the drive shaft. A first one-way clutch transmits rotation between the first flange and the drive shaft only during relative rotation in one direction. An engine pulley connects to the first flange and is rotatably connected to the crankshaft of the engine. A second flange coaxially mounts about the drive shaft. A second one-way clutch transmits rotation between the second flange and the drive shaft only during relative rotation in one direction. A drive pulley connects to the second flange and is rotatably connected to an output shaft of a motor, preferably a direct current electric motor. A fan is rotatably mounted adjacent the radiator and fixedly connected to the second flange. The electric motor is adapted to rotate the pump and the fan during non-operation and slow speed of the vehicle, and the vehicle engine is adapted to rotate the pump during high speed of the engine while the electric motor continues to rotate the fan. During rapid forward movement of the vehicle, the resulting airstream which engages the fan tends to rotate the fan and cause the electric motor to operate as a generator for a battery connected thereto.

DETAILED DESCRIPTION OF THE DRAWINGS

DETAILED DESCRIPTION OF THE ILLUSTRATED EMBODIMENTS

The present invention now will be described more fully hereinafter with reference to the accompanying drawings in which illustrated embodiments of the invention are shown. This invention may, however, be embodied in many different forms and should not be construed as limited to the embodiments set forth herein; rather, these embodiments are provided so that this disclosure will be thorough and complete and will fully convey the scope of the invention to those skilled in the art. Like numbers refer to like elements throughout.

Figure 1:
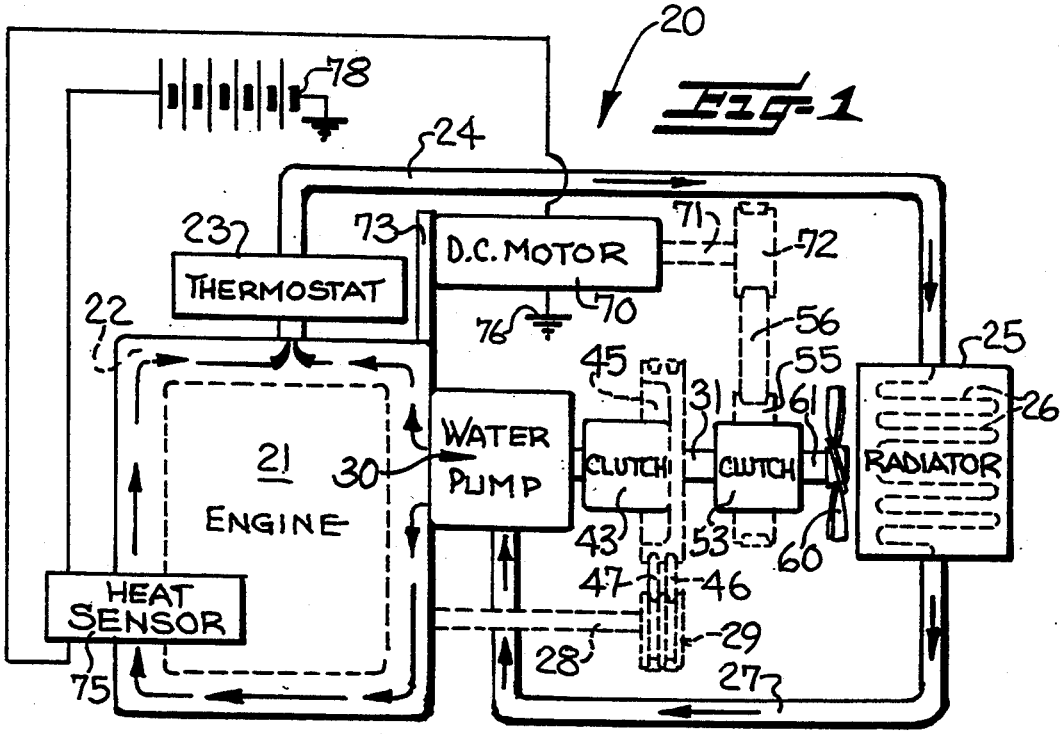
FIG. 1 is a schematic diagram of an engine cooling system according to a first embodiment of the present invention.
Figure 2:
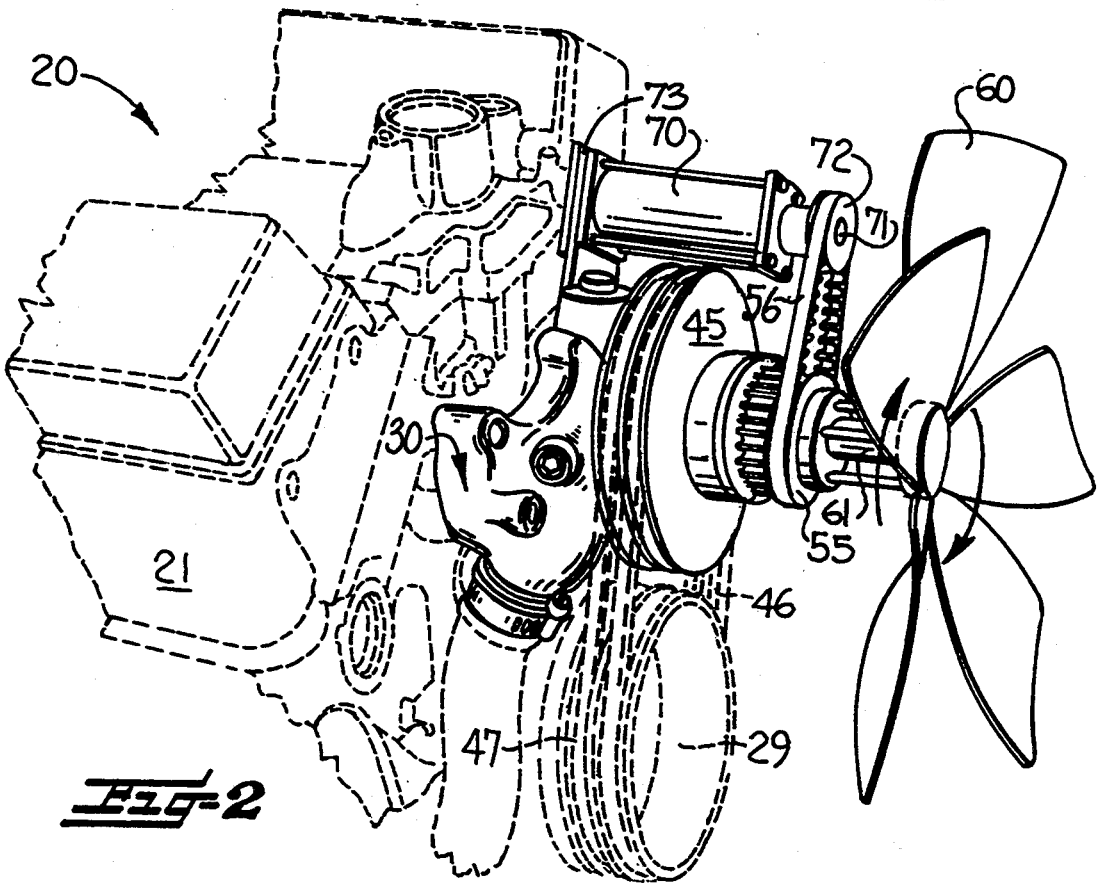
FIG. 2 is a perspective view of an engine cooling system compactly mounted to an engine according to the present invention with broken lines illustrating portions of the engine for clarity.
Figure 12:
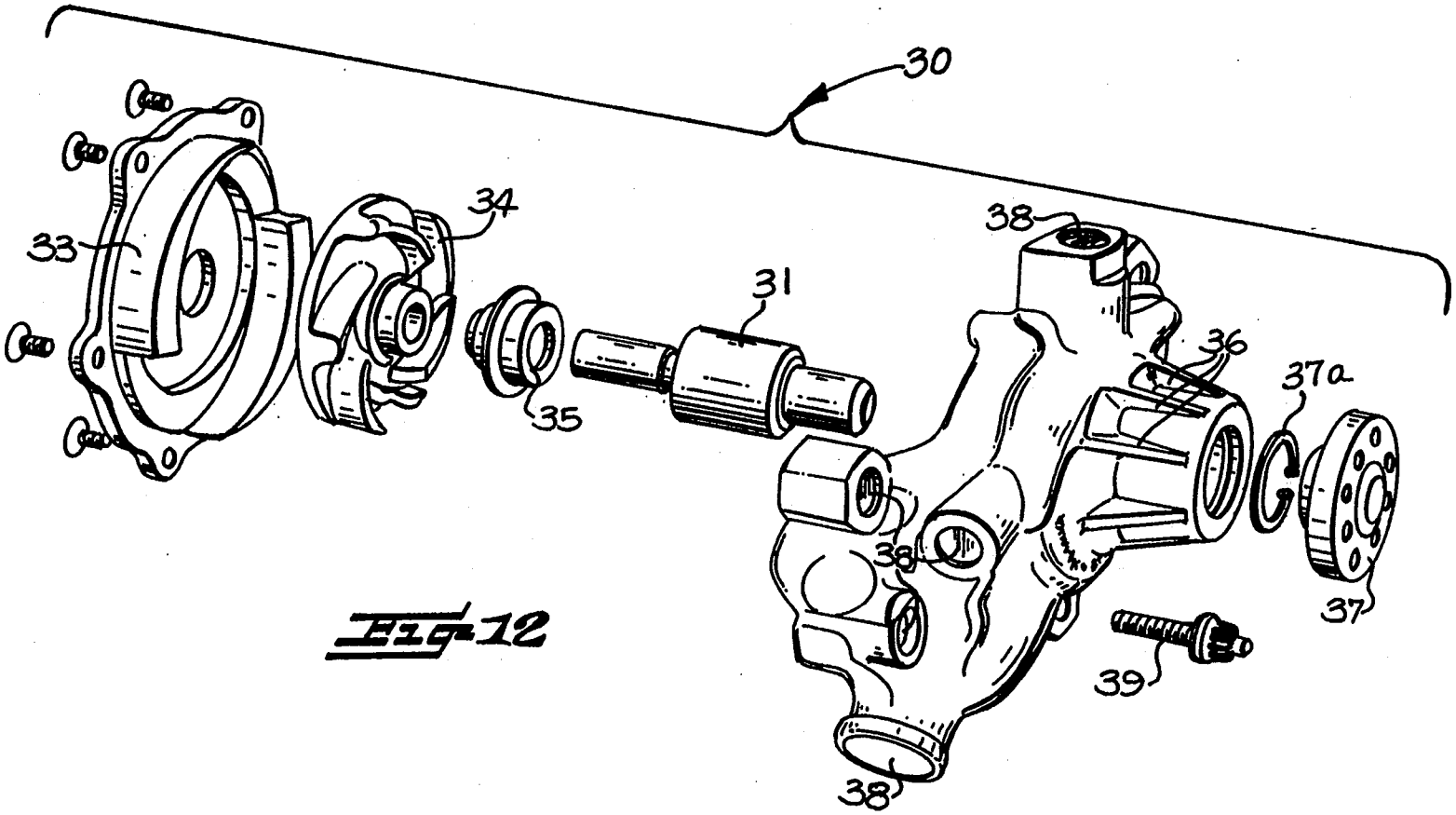
FIG. 12 is an exploded view of a pump according to the present invention.

As shown in FIGS. 1 and 2, the engine cooling system 20 according to the present invention has an engine 21 having a crankshaft 28 and a fluid passageway passing through the engine block 22 for circulating cooling fluid, such as a water and antifreeze mixture, through the engine 21 to thereby cool the engine 21. A radiator 25 also having a fluid passageway 26 therein is in fluid communication with the engine 21 for cooling fluid circulating through fluid passageways 24, 27 to and from the engine 21. A pump 30 is in fluid communication with the engine 21 and the radiator 25 and pumps cooling fluid from the engine cooling fluid passageway 22 to the radiator cooling fluid passageway 26 and vice versa. The pump 30, as best shown in FIG. 12 discussed later herein, has a pump drive shaft 31 longitudinally extending outwardly from a pump housing 32. The pump drive shaft 31 cooperates with the engine crankshaft 28 to operate the pump during operation of the engine 21. A fan 60 preferably compactly mounted to the pump drive shaft 31 cooperates with the radiator 25 to cool fluid passing therethrough.

Figure 3:
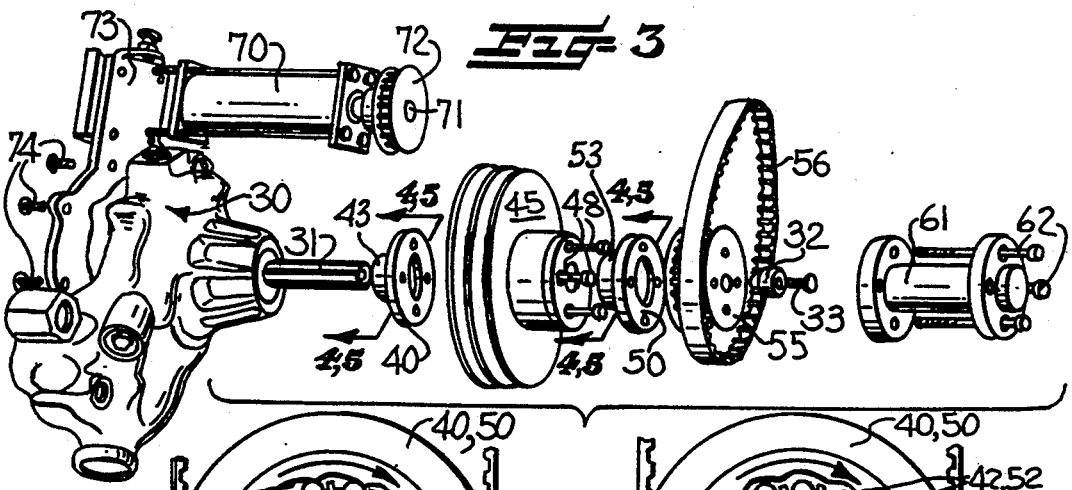
FIG. 3 is an exploded view of a pump system according to the present invention.
Figure 4:
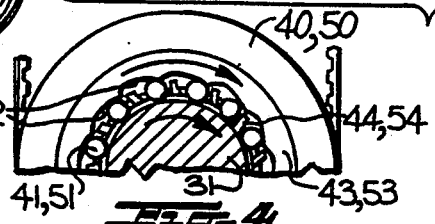
FIG. 4 is a partial cross-sectional view taken along lines 4—4 of FIG. 3 of a clutch according to the present invention.
Figure 5:
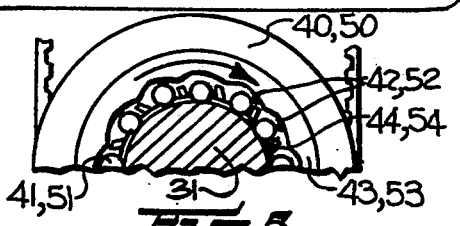
FIG. 5 is a partial cross-sectional view taken along lines 5—5 of FIG. 3 of a clutch according to the present invention.

As best shown in FIGS. 3–5, a first flange 40 is coaxially mounted about the drive shaft 31 of the pump 30. The first flange 40 preferably has a first one-way roller clutch 43 mounted thereto for transmitting rotation between the first flange 40 and the drive shaft 31 only during relative rotation in one direction. An engine pulley 45 connects to the first flange 40 and is rotatably connected to the engine crankshaft 28 of the engine 21 by crankshaft pulley 29. The engine pulley 45 preferably connects to the engine crankshaft 28 through two belts 46, 47. A second flange 50 also coaxially mounts about the drive shaft 31 and a second one-way roller clutch 53 is preferably mounted to the second flange 50 for transmitting rotation between the second flange 50 and the drive shaft 31 only during relative rotation in one direction.

Figure 6:
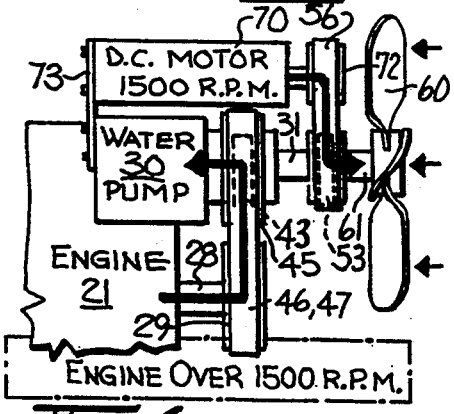
FIG. 6 is a schematic diagram illustrating operation of an engine cooling system according to the present invention when the engine is operating over 1500 revolutions per minute ("RPM")
Figure 7:
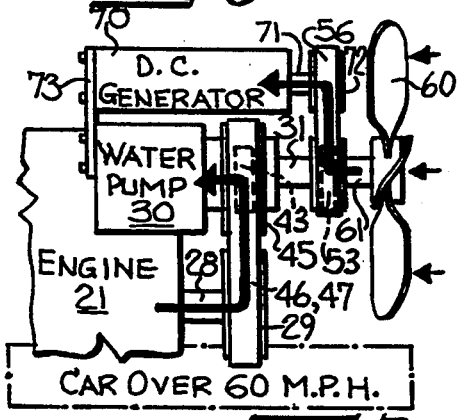
FIG. 7 is a schematic diagram illustrating operation of an engine cooling system according to the present invention when the engine is operating over 60 miles per hour.
Figure 8:
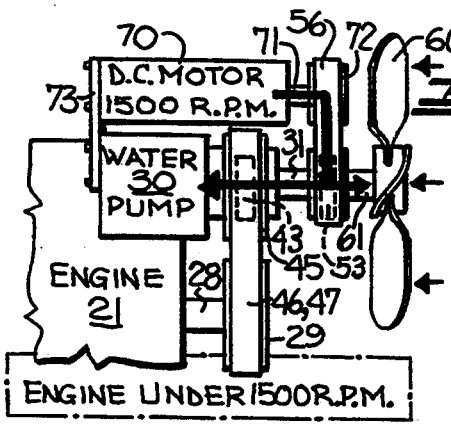
FIG. 8 is a schematic diagram illustrating operation of an engine cooling system according to the present invention when the engine is operating under 1500 RPM.
Figure 9:
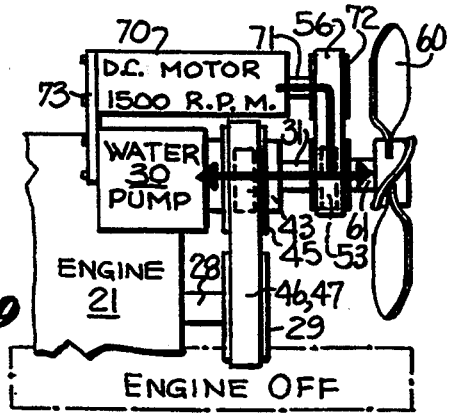
FIG. 9 is a schematic diagram illustrating operation of an engine cooling system according to the present invention when the engine is at shut off position.

A drive pulley 55 connects to the second flange 50 and is rotatably connected to an output shaft 71 of a motor 70. The motor is preferably compactly mounted to a base plate 73 also having the pump so commonly mounted thereto by fasteners 74 as best shown in FIGS. 2 and 3. The drive pulley 55 connects to the output shaft 71 of the motor 70 through belt 56. The fan 60 is rotatably mounted adjacent the radiator 25 and is also fixedly connected to the second flange 50 by a fan extender shaft 61 and a plurality of bolts 62. The motor 70 is adapted to rotate the pump 30 and the fan 60 during non-operation and slow speed of the vehicle engine 21 (as best shown in FIGS. 8 and 9) and the vehicle engine 21 is adapted to rotate the pump during high speed of the engine 21 while the motor 70 continues to rotate the fan 60 (as best shown in FIG. 6). Also, during rapid movement of the vehicle, i.e., speeds exceeding 60 miles per hour ("MPH") the resulting airstream which engages the fan 60 tends to rotate the fan 60 and cause the motor 70 to operate as a generator (as best shown in FIG. 7). Further, the cooperation of the clutches 43, 53 with the pump drive shaft 31, the engine crankshaft 28, the fan 60, and the motor 70 is such that the pump and fan speed are maintained at a predetermined level during operation to thereby improve the overall horsepower of the engine 21.

According to the present invention, the pump drive shaft 31 is longer than conventional pump drive shafts so that the flanges 40, 50, pulleys 45, 55, and a flange retainer 32 secured thereto by a screw 33 may be securely added to the extended pump drive shaft 31. As best shown in FIGS. 1 and 3, the motor 70 is preferably a direct current ("D.C.") electric motor and is in electrical communication with a charge storage device 78 such as the conventional D.C. battery used in many vehicles. The electric motor 70 is also preferably grounded by lead 76 for the various safety and operational reasons known to those skilled in the art. The motor 70 cooperates with the pump drive shaft 31 to operate the pump 30 at a predetermined speed even when the engine 21 is in an idle or shut off position. For example, the motor 70 turns the fan 60 and the pump 70 at 1500 RPM when the engine crankshaft 28 is turning at a lower speed. When the engine crankshaft 28 exceeds 1500 RPM the pump 70 begins to turn at the speed of the engine crankshaft 28, but because of the one-way roller clutches 43, 53 the fan continues to turn at 1500 RPM. The fan 60 is compactly coupled to the pump drive shaft 31 (as best shown in FIGS. 2 and 3) and cooperates with the radiator 25 and the pump 30 to cool fluid circulating through the radiator 25 via the radiator passageway 26.

A temperature sensor 75 is connected to the engine 21 to sense the engine temperature particularly during idle and shut off positions. The temperature sensor 75 is also preferably electrically connected to the motor 70 so that if the temperature of the engine 21 exceeds a predetermined value, then the motor 70 is turned on and, in turn, operates the pump 30 and the fan 60 to continue the circulation of fluid from the engine 21 to the radiator 25. This circulation cools the fluid passing through the radiator 25 to thereby cool the engine 21 during idle and shut off. During shut off of the engine 21, the motor 70 preferably operates the pump 30 and fan 60 for a period of time until the temperature sensor 75 senses that the engine temperature has fallen below a predetermined value.

As illustrated in FIGS. 3–5, the first and second flanges 40, 50 have a generally circular shape and preferably have first and second one-way roller clutches connected thereto 43, 53 the clutches 43, 53 each have a race 42, 52, with a plurality of spaced-apart concave recesses therein. FIGS. 4 and 5 are enlarged fragmentary views of the roller clutches 43, 53 which best illustrate the internal operation of the clutches 43, 53. A plurality of clutch rollers 41, 51 cooperate with the pump drive shaft 31 which operates as a drive shaft for the rollers 41, 51. Depending on the direction the pump shaft 31 turns or which direction the clutches 43, 53 turn, the rollers 41, 51 either move up or down the recesses of the race 42, 52. If the rollers 41, 51 move down the recesses, the rollers 41, 51 become wedged against the shaft and the race 42, 52 and the clutch 40, 50 are engaged. The roller clutches 43, 53 are conventional, and may, for example, comprise the clutches sold by Torrington as model number RCB101416.

FIGS. 6–9 illustrate examples of the operation of the engine 21, the pump 30, the fan 60, and the motor 70 for various functions of the engine cooling system 20 according to the present invention. It will be understood by those skilled in the art that other predetermined values for RPM, vehicle speed, and engine temperature may also be used according to the invention. As shown in FIG. 6, if the engine crankshaft 28 is turning at a rate over 1500 RPM for example, then the pump shaft 31 turns at a rate corresponding to the engine crankshaft 20 speed. As shown in FIG. 7, if the vehicle is traveling at a rate over 60 MPH, then the fan 60 can rotate at a faster speed than normal. The motor 70 then operates like a generator to charge the charge storage device 78 which is in electrical communication with the motor 70. As shown in FIGS. 8 and 9, if the engine 21 is in an idle position, i.e., under 1500 RPM or shut-off, then the roller clutches 43, 53, cooperate with the pump shaft 31 and the motor output shaft 71 to continue the operation of the pump 30 and the fan 60 and thereby cool the engine 21 of the vehicle. The motor 70 then shuts off after the engine temperature sensed by the heat sensor 75 drops below a predetermined value, i.e., after about 10 minutes of operation.

More particularly, during the conditions of FIGS. 8 and 9, the motor 70 drives the pump drive shaft 31 through the second clutch 53, and the first clutch 43 is disengaged. When the engine speed reaches 1500 RPM as seen in FIG. 6 (or some other speed which is determined by the operating speed of the motor 70), the rotational speed of the engine pulley 45 causes the first clutch 43 to become engaged and so that the engine pulley 45 takes over the drive of the pump drive shaft 31. The pump drive shaft 31 then rotates faster than the speed of the drive pulley 55 which is driven by the motor 70, and thus the second clutch 53 becomes disengaged. The motor 70, however, continues to rotate the fan 60 since the fan 60 is fixed to the drive pulley 55. Upon the vehicle moving forward at a predetermined speed as seen in FIG. 7 (for example 60 MPH), the airstream which impacts upon the fan causes it to rotate at a speed faster than it is being driven by the motor 70. As a result, the output shaft 71 of the motor 70 will rotate faster than its normal operating speed, causing the motor 70 to act as a generator and thereby charge the charge storage device 78, i.e., battery.

Figure 10:
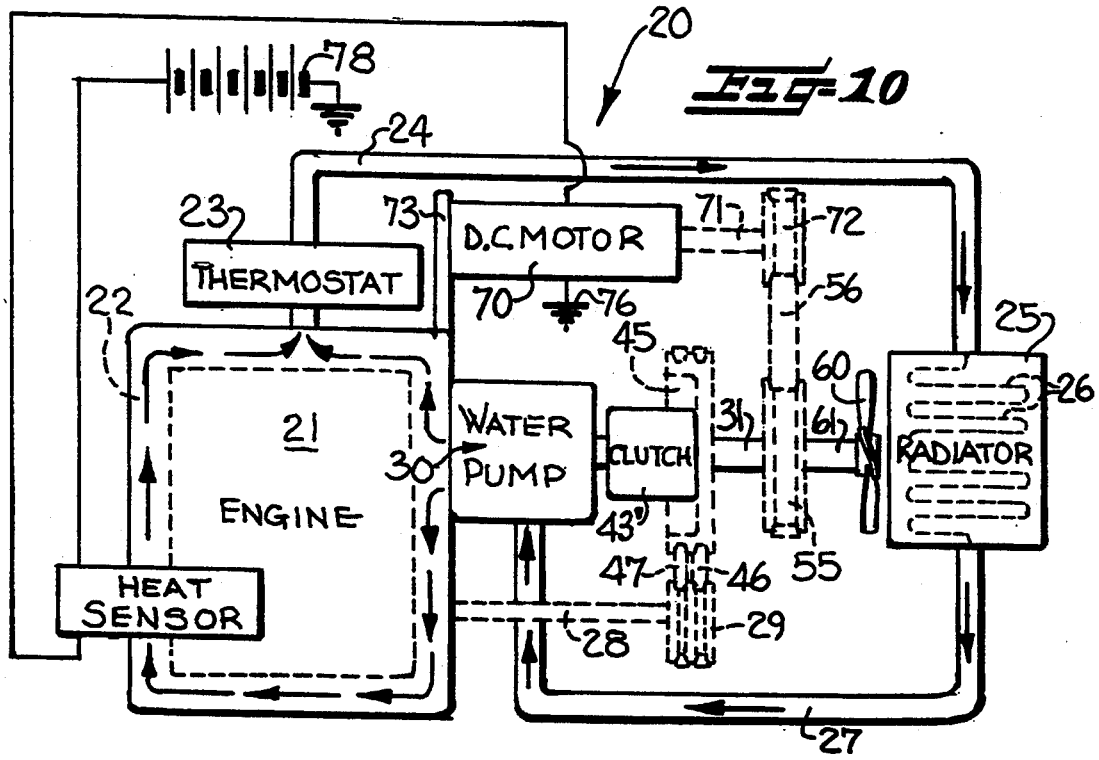
FIG. 10 is a schematic diagram of an engine cooling system according to a second embodiment of the present invention.
Figure 11:
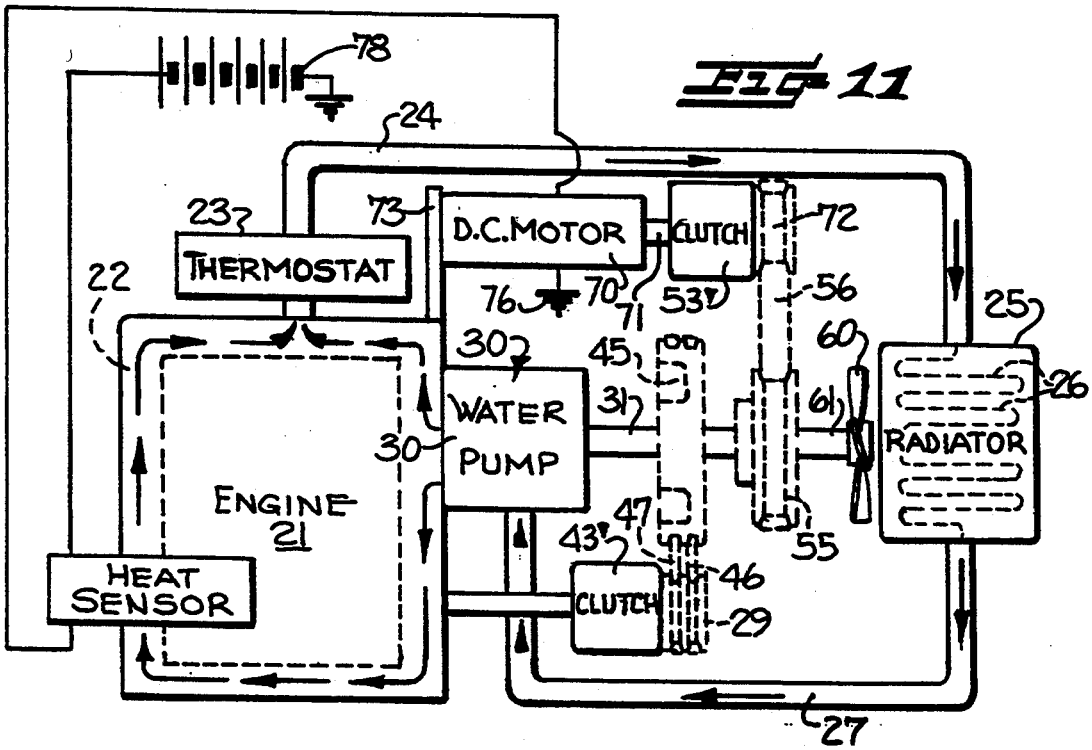
FIG. 11 is a schematic diagram of an engine cooling system according to a third embodiment of the present invention.

FIGS. 10 and 11 are alternative embodiments of the engine cooling system 20 according to the present invention. Most elements in the system are similar to those illustrated with reference to FIG. 1 except the number and positioning within the engine cooling system 20 of the first and clutches 43', 53' which are designated with prime (') notation. Accordingly, a detailed description of the other elements will not be discussed to avoid repetitiveness. As illustrated, the flanges 43', 53' may be positioned either on the pump drive shaft 31, on the engine crankshaft 28, or on the motor shaft 71 to thereby provide similar operations as discussed with reference to the first embodiment as described in FIG. 1. It will also be apparent to those skilled in the art that other combinations of one or more clutches may also be used according to the present invention.

The schematic diagram of FIG. 10 which is an alternative embodiment of an engine cooling system 20 according to the present invention illustrates an embodiment wherein the motor 70 is driven by the vehicle engine 21 when the speed of the engine crankshaft 28 exceeds the speed at which the motor 70 is being driven. The fan 60, which is preferably attached to the pump drive shaft 31, will also be driven by the engine crankshaft 28. This embodiment may be particularly useful in applications needing a significant amount of airstream flow generated by the fan 60 such as in vehicles with undersized grill openings, i.e., smaller than conventional vehicles, to the radiator and fan area. Also, for example, vehicles traveling or racing on dirt surfaces tend to load the grill with mud and the fan 60 is conventionally forced to draw air from around the front wheels or other openings under-the-hood of the vehicle. This embodiment may also be useful for vehicles traveling in these conditions.

FIG. 12 further illustrates the construction of the pump 30 according to the present invention. The pump 30 has a housing 32 which is preferably formed of aluminum or an aluminum alloy and has a plurality of ribs 36 positioned adjacent the pump drive shaft 31. A billet diffuser 33 and impeller 34 cooperate with and are secured to the housing 32 to provide a pumping operation and thereby fluid circulation for the pump 30. A seal assembly 35 and ball or roller bearing cooperate with the pump shaft 31 through a fan hub 37, preferably a dual pattern billet fan hub. An O-ring **37*a* seals the fan hub 37 within one of a plurality of openings 38 in the housing 32 from which the drive shaft 31 extends therefrom. A cam stop 39 is secured to the housing 32 to provide a seal and stop position. The billet diffuser 33 is secured to the housing 32 by a plurality of fasteners, such as the screws illustrated. The elongated pump shaft 31 (as best shown in FIGS. 1–3 and 12), in turn, cooperates with the flanges 40, 50 and the one-way clutches 43, 53** to operate the pump at predetermined time intervals.

Also, a method of charging a battery by use of a cooling fan 60 which cooperates with a radiator 25 mounted in a vehicle during the forward movement of the vehicle has also been described. The method includes rotating the fan 60 which cooperates with the radiator 25 mounted in the vehicle during rapid forward movement of the vehicle by the airstream which engages the fan 60. The output shaft 71 of the motor 70 connected to the fan 60 is rotated responsive to the rotation of the fan 60. A charge is thereby generated to the charge storage device 78 connected to the motor 70 responsive to the rotation of the output shaft 71 of the motor 70.

Further, a method of more efficiently operating an engine cooling system for a vehicle has also been described herein whereby the vehicle has an internal combustion engine 21 including an engine crankshaft 28, a radiator 25, a pump 30 in fluid communication with the engine 21 and the radiator 25 for circulating fluid therebetween and including a pump drive shaft 31, a motor 70 connected to the drive shaft 31 and including an output shaft 71, and a fan 60 connected to the drive shaft 31 and the output shaft 71 of the motor 70. The method includes rotating the drive shaft 31 of the pump 30 and the fan 60 responsive to the output shaft 71 of the motor 70 connected to the pump drive shaft 31 to thereby circulate cooling fluid between the radiator 25 and the engine 21 until the engine crankshaft 28 reaches a predetermined speed, i.e., 1500 RPM. The drive shaft 31 of the pump 30 is then rotated responsive to the engine crankshaft 28 when the engine crankshaft 28 reaches the predetermined speed to thereby circulate cooling fluid between the radiator 25 and the engine 21. The fan 60 continues to rotate responsive to the output shaft 71 of the motor 70 when the engine crankshaft 28 reaches the predetermined speed. Also, the output shaft 71 of the motor 70 is rotated at a faster speed than the output shaft 71 is driving the fan 60 during forward movement of the vehicle to thereby generate a charge to the charge storage device 78 connected to the motor 70. More particularly, as described above, when the vehicle reaches a predetermined speed the airstream engaging the fan 60 causes the fan 60 to rotate at a faster speed than it is being driven by the motor 70 and thereby causes the motor 60 to act like a generator.

In the drawings and specification, there have been disclosed typical illustrative embodiments of the present invention, and although specific terms are employed, they are used in a generic and descriptive sense only and not for purposes of limitation, the scope on the invention being set forth in the following claims.

That which is claimed is:

1. An engine cooling system for more efficiently pumping fluid through an engine and a radiator of a vehicle, said engine cooling system comprising:

an engine;

charge storage means in electrical communication with said engine for supplying an electrical charge to said engine;

a radiator in fluid communication with said engine for cooling fluid passing through said radiator from said engine;

a pump in fluid communication with said engine and said radiator for pumping fluid from said engine to said radiator and to said engine from said radiator;

a fan positioned adjacent said radiator and arranged to cool fluid circulating through said radiator;

temperature sensing means connected to said engine for sensing the temperature of said engine;

pump control means in electrical communication with said temperature sensing means and connected to said pump for operating said pump responsive to the sensed temperature of said engine exceeding a predetermined value; and charge control means connected to said fan for controlling the operation of said fan such that a motor connected to said fan operates as a generator and charges said charge storage means responsive to the vehicle exceeding a predetermined speed.

2. An engine cooling system as defined by claim 1, wherein said pump control means comprises:

a motor in electrical communication with said temperature sensing means; and clutch means connected to said pump, said engine and said motor for selectively operating said pump responsive to said engine above a predetermined engine speed and responsive to said motor below a predetermined engine speed and thereby circulate fluid to and from said engine when the sensed engine temperature exceeds a predetermined value.

3. An engine cooling system as defined by claim 1, wherein said charge control means comprises:

a motor connected to said fan; and clutch means responsive to said fan for selectively operating said fan such that said motor operates as a generator and charges said charge storage means responsive to the vehicle exceeding a predetermined speed.

4. An engine cooling system as defined by claims 2 or 3, wherein said motor comprises a direct current electrical motor.

5. An engine cooling system as defined by claims 2 or 3, wherein said clutch means comprises a one-way roller clutch.

6. An engine cooling system as defined by claim 1, wherein said fan is connected to said pump and said pump control means is connected to said engine for responsively operating said pump and said fan.

7. An engine cooling system as defined by claim 1, wherein said charge storage means comprises a battery.

8. An engine cooling system as defined by claim 1, further comprising a thermostat in fluid communication with said engine and said radiator for sensing the temperature of the fluid flowing between said engine and said radiator.

9. An engine cooling system for more efficiently pumping fluid through an engine and a radiator of a vehicle, said engine cooling system comprising:

an engine having a crankshaft rotating at a rate corresponding to a speed of said engine;

a battery in electrical communication with said engine for supplying a charge to said engine;

a radiator in fluid communication with said engine for cooling fluid passing therethrough;

a pump in fluid communication with said engine and said radiator for pumping fluid to and from said engine and to and from said radiator, said pump having a drive shaft longitudinally extending outwardly therefrom, said pump drive shaft connected to said engine crankshaft for operating said pump responsive to the rotation of said engine crankshaft above a predetermined engine speed;

a fan coupled to said pump drive shaft and positioned adjacent said radiator for cooling fluid circulating through said radiator;

a temperature sensor connected to said engine for sensing the temperature of said engine;

a motor connected to said pump drive shaft and in electrical communication with said temperature sensor, said motor having an output shaft longitudinally extending outwardly therefrom; and clutch means mounted to said pump drive shaft and connected to said engine crankshaft and said motor for selectively operating said pump and said fan to thereby circulate fluid to and from the engine when the sensed engine temperature exceeds a predetermined value and for selectively operating said fan and said motor to thereby charge said battery responsive to the vehicle exceeding a predetermined speed.

10. An engine cooling system as defined by claim 9, wherein said motor comprises a direct current electric motor.

11. An engine cooling system as defined by claim 9, wherein said clutch means comprises a pair of one-way roller clutches.

12. An engine cooling system as defined by claim 9, further comprising a thermostat in fluid communication with said engine and said radiator for sensing the temperature of the fluid flowing between said engine and said radiator.

13. An engine cooling system for more efficiently pumping fluid through an engine and a radiator of a vehicle, said engine cooling system comprising:

an engine having a crankshaft;

a radiator;

an electric motor mounted to said engine and having an output shaft;

cooling means for circulating fluid through said engine and said radiator so as to cool said engine, said cooling means comprising (a) a pump including a drive shaft, (b) a first flange coaxially mounted about said drive shaft, (c) first one-way clutch means for transmitting rotation between said first flange and said drive shaft only during relative rotation in one direction, (d) an engine pulley connected to said first flange and being rotatably connected to the crankshaft of said engine, (e) a second flange coaxially mounted about said drive shaft, (f) second one-way clutch means for transmitting rotation between said second flange and said drive shaft only during relative rotation in one direction, and (g) a drive pulley connected to said second flange and being rotatably connected to said output shaft of said electric motor; and a fan rotatably mounted adjacent said radiator and fixedly connected to said second flange, whereby said electric motor is adapted to rotate said pump and said fan during non-operation and operation below a predetermined speed of the vehicle engine, and the vehicle engine is adapted to rotate said pump above said predetermined speed of the engine while said electric motor continues to rotate said fan, and whereby during rapid forward movement of said vehicle the resulting flow of air engages said fan such that said fan rotates at a speed greater than the rotational speed of said motor and causes said electric motor to operate as a generator.

14. An engine cooling system as defined by claim 13, further comprising a battery electrically connected to said engine and said electric motor so that said battery provides an electrical charge to said engine and said electric motor charges said battery when said motor operates as a generator.

15. An engine cooling system as defined by claim 13, further comprising a temperature cooling sensor connected to said engine and said electric motor so that said electric motor operates said pump when the temperature of said engine exceeds a predetermined value and the speed of said engine is below the speed of said motor.

16. An engine cooling system as defined by claim 13, wherein said first and second one-way clutch means are oriented so that rotation is transmitted to said pump drive shaft from said first and second flanges only responsive to rotation in the same rotational direction of said first and second flanges.

17. A pump system adapted for more efficiently cooling a vehicle engine, said pump system comprising:

a pump including a drive shaft;

a first flange coaxially mounted about said pump drive shaft;

first one-way clutch means for transmitting rotation between said first flange and said pump drive shaft only during relative rotation in one direction;

an engine pulley connected to said first flange and to adapted to be rotatably connected to a crankshaft of a vehicle engine;

a second flange coaxially mounted about said pump drive shaft;

second one-way clutch means for transmitting rotation between said second flange and said pump drive shaft only during relative rotation in one direction; and a drive pulley connected to said second flange and which is adapted to be rotatably connected to a separate drive motor and to the fan of a vehicle engine, whereby rotation of said second flange rotates said pump drive shaft and the fan during non-rotation and slow speed rotation of said first flange, and rotation of said first flange at high speed rotates said pump drive shaft while rotation of said second flange continues to rotate the fan.

18. A pump system as defined by claim 17, wherein said first and second one-way clutch means are oriented so that rotation is transmitted to said pump drive shaft from said first and second flanges only responsive to rotation in the same rotational direction of said first and second flanges.

19. A pump system as defined by claim 17, wherein said first and second one-way clutch means each comprises a one-way roller clutch.

20. A pump for an engine cooling system to more efficiently pump cooling fluid through an engine and a radiator of a vehicle, said pump comprising:

a housing having a plurality of openings therein for fluid communication with an engine and a radiator of a vehicle, said openings allowing fluid to flow through said housing;

a drive shaft extending outwardly from said housing, an outer end of said shaft being adapted to couple to a fan;

rotary means positioned within said housing and coupled to an inner end of said drive shaft for circulating fluid through said housing responsive to rotation of said drive shaft; and a pair of clutches carried by said drive shaft and positioned between said inner end and said outer end thereof, one of said pair of clutches being adapted to cooperate with a crankshaft of an engine and the other of said pair of clutches being adapted to cooperate with a motor so that when the temperature of an engine exceeds a predetermined value such as during non-operation and slow speed of the vehicle engine said drive shaft rotates to operate said rotating means of the pump.

21. A pump as defined by claim 20, wherein said rotating means comprises an impeller.

22. A pump as defined by claim 20, wherein said pair of clutches each comprise a one-way roller clutch.

23. A pump as defined by claim 20, further comprising means for operatively securing said pair of clutches to said shaft.

24. A pump as defined by claim 20, further comprising a tubular member positioned on said shaft and between said pair of clutches for spacing said clutches a predetermined distance apart on said shaft.

25. A pump for an engine cooling system to more efficiently pump fluid through an engine and a radiator of a vehicle, said pump comprising:

a housing having a plurality of openings therein for fluid communication with an engine and a radiator of a vehicle, said openings allowing fluid to flow through said housing;

a drive shaft extending outwardly from said housing, an outer end of said shaft being adapted to couple to a fan;

an impeller positioned within said housing and coupled to an inner end of said shaft for circulating fluid through said housing responsive to rotation of said shaft;

a first flange coaxially mounted about said drive shaft and adapted to be rotatably connected to an engine crankshaft;

a first one-way clutch for transmitting rotation between said first flange and said drive shaft only during relative rotation in one direction;

a second flange coaxially mounted about said drive shaft and adapted to be rotatably connected to an output shaft of an electric motor and the fan; and a second one-way clutch for transmitting rotation between the second flange and the drive shaft only during relative rotation in one direction;

whereby the electric motor rotates said drive shaft during non-operation and operation below a predetermined speed of the vehicle engine, and the vehicle engine rotates the drive shaft above said predetermined speed of the engine while the electric motor continues to rotate the fan, and whereby during rapid forward movement of the vehicle the resulting flow of air engages said fan such that said fan rotates at a speed greater than the rotational speed of said motor and causes the electric motor to operate as a generator.

26. A method of charging a battery only during rapid forward movement of a vehicle by use of a cooling fan mounted in a vehicle comprising the steps of:

rotating a fan mounted in a vehicle and positioned to receive a flow of air responsive to rapid forward movement of the vehicle;

rotating an output shaft of a motor connected to the fan responsive to the rotation of the fan only when the rotational speed of the fan exceeds a predetermined rotational speed of the motor so that the motor operates as a generator; and generating a charge to a battery connected to the motor responsive to the rotation of the output shaft of the motor.

27. A method of more efficiently operating an engine cooling system for a vehicle having an internal combustion engine including an engine crankshaft, a radiator, a pump in fluid communication with the engine and the radiator for circulating fluid therebetween and including a pump drive shaft, a motor connected to the drive shaft and including an output shaft, and a fan connected to the drive shaft and the output shaft of the motor, comprising the steps of:

rotating the drive shaft of the pump and the fan responsive to the output shaft of the motor connected to the pump drive shaft to thereby circulate fluid between the radiator and the engine until the engine crankshaft reaches a predetermined speed;

rotating the drive shaft of the pump responsive to the engine crankshaft when the engine crankshaft reaches the predetermined speed to thereby circulate fluid between the radiator and the engine; and rotating the fan responsive to the output shaft of the motor when the engine crankshaft reaches the predetermined speed.

28. A method as defined by claim 27, further comprising the step of:

rotating the output shaft of the motor at a faster speed than the output shaft is driving the fan during rapid forward movement of the vehicle to thereby generate a charge with the motor.

* * * * *